US009427120B1

(12) United States Patent
Valentine

(10) Patent No.: US 9,427,120 B1
(45) Date of Patent: Aug. 30, 2016

(54) SYSTEM AND METHOD FOR CREATING CURRENCY RAIN

(76) Inventor: Kenny D. Valentine, Dallas, TX (US)

( * ) Notice: Subject to any disclaimer, the term of this patent is extended or adjusted under 35 U.S.C. 154(b) by 952 days.

(21) Appl. No.: 13/193,408

(22) Filed: Jul. 28, 2011

(51) Int. Cl.

| | |
|---|---|
| ***B65G 59/00*** | (2006.01) |
| ***B65D 83/00*** | (2006.01) |
| ***A47K 10/42*** | (2006.01) |
| *B65H 1/06* | (2006.01) |

(52) U.S. Cl.
CPC ..... *A47K 10/424* (2013.01); *B65H 1/06* (2013.01); *B65H 2701/1912* (2013.01)

(58) Field of Classification Search
USPC ..... 221/2, 3, 197, 208, 253, 258, 259, 277, 221/287
See application file for complete search history.

(56) References Cited

U.S. PATENT DOCUMENTS

| | | | | | |
|---|---|---|---|---|---|
| 2,766,989 | A * | 10/1956 | Sivertson | 273/149 R | |
| 4,020,972 | A * | 5/1977 | Lundblad | 221/13 | |
| 4,352,348 | A * | 10/1982 | Griffith | 124/78 | |
| 4,884,992 | A * | 12/1989 | Grimes | 453/29 | |
| 4,890,404 | A * | 1/1990 | Ferri | 42/57 | |
| 4,910,646 | A * | 3/1990 | Kim | 362/112 | |
| 4,995,374 | A * | 2/1991 | Black | 124/54 | |
| 5,383,569 | A * | 1/1995 | Muto | 221/203 | |
| 5,448,984 | A * | 9/1995 | Brovelli | 124/69 | |
| 5,471,967 | A * | 12/1995 | Matsuzaki et al. | 124/6 | |
| 5,613,482 | A * | 3/1997 | Thai et al. | 124/16 | |
| 5,718,427 | A * | 2/1998 | Cranford et al. | 273/149 R | |
| 5,996,564 | A * | 12/1999 | Kotowski | 124/6 | |
| 6,116,229 | A * | 9/2000 | Wu | 124/6 | |
| 6,199,856 | B1 * | 3/2001 | Clauser | B65H 29/46 271/180 | |
| 6,299,018 | B1 * | 10/2001 | Kimbrell | 221/71 | |
| RE37,616 | E * | 4/2002 | Schumacher | 124/66 | |
| 6,394,306 | B1 * | 5/2002 | Pawlo et al. | 221/2 | |
| 7,100,592 | B1 * | 9/2006 | Yang | 124/67 | |
| 7,753,375 | B1 * | 7/2010 | Neal et al. | 273/317.3 | |
| 9,189,908 | B2 * | 11/2015 | Sampson | G07D 11/0021 | |
| 2003/0192904 | A1 * | 10/2003 | Yu | 221/197 | |
| 2006/0046613 | A1 * | 3/2006 | Mann | A63H 37/00 446/475 | |
| 2007/0095293 | A1 * | 5/2007 | Moulton | 119/51.01 | |
| 2007/0215634 | A1 * | 9/2007 | Levin | 221/231 | |
| 2010/0181161 | A1 * | 7/2010 | Gauselmann | 194/206 | |
| 2013/0312722 | A1 * | 11/2013 | Price | F41B 15/00 124/1 | |
| 2014/0165985 | A1 * | 6/2014 | Bryngelson | A63H 37/00 124/82 | |
| 2014/0217111 | A1 * | 8/2014 | Sampson | G07D 11/0021 221/1 | |

* cited by examiner

*Primary Examiner* — Gene Crawford
*Assistant Examiner* — Kelvin L Randall, Jr.
(74) *Attorney, Agent, or Firm* — Norton Rose Fulbright US LLP

(57) ABSTRACT

By using an automated money dispenser, a patron can "shoot" currency in the direction of a performer from any reasonable distance and can control the rate of dispensing as well as the total amount dispensed. In some embodiments, the dispenser can emit sounds, light or other special effects to further enhance the experience for the dispensing patron, for other patrons, as well as for the performer. The present invention allows for a unique experience both for the user and for the entertainer, allowing for role-play and other types of entertainment not available in the prior art.

16 Claims, 3 Drawing Sheets

SYSTEM AND METHOD FOR CREATING CURRENCY RAIN

TECHNICAL FIELD

The present invention relates to "raining" money or other valuables onto a performer during a performance and more particularly to systems and methods for controllably dispensing paper currency in the direction of a live performer.

BACKGROUND OF THE INVENTION

In entertainment venues it is common for patrons of a venue to give gratuities to entertainers by way of throwing a large quantity of small denomination currency, one bill at a time, in the direction of the performer. A frequently used method of giving these tips to entertainers is "making rain," i.e., dispatching currency from between one's hands rapidly to give the appearance of falling rain. Rain making is often done for the purpose of impressing fellow patrons, by dispensing a large quantity of paper currency. The currency dispensed could be ones, fives, tens, or any denomination. While this practice seems to be popular among certain apparently affluent patrons, it suffers from several problems, such as, 1) the currency must be dispatched from a position relatively close to the performer; 2) there is no accurate count of how much is being dispatched; and 3) only patrons close to the dispatcher really know how much is being rained down.

BRIEF SUMMARY OF THE INVENTION

By using an automated money dispenser, a patron can "shoot" currency in the direction of a performer from any reasonable distance and can control the rate of dispensing as well as the total amount dispensed. In some embodiments, the dispenser can emit sounds, light or other special effects to further enhance the experience for the dispensing patron, for other patrons, as well as for the performer. The present invention allows for a unique experience both for the user and for the entertainer, allowing for role-play and other types of entertainment not available in the prior art.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawing, in which.

DETAILED DESCRIPTION OF THE INVENTION

Figure 1:
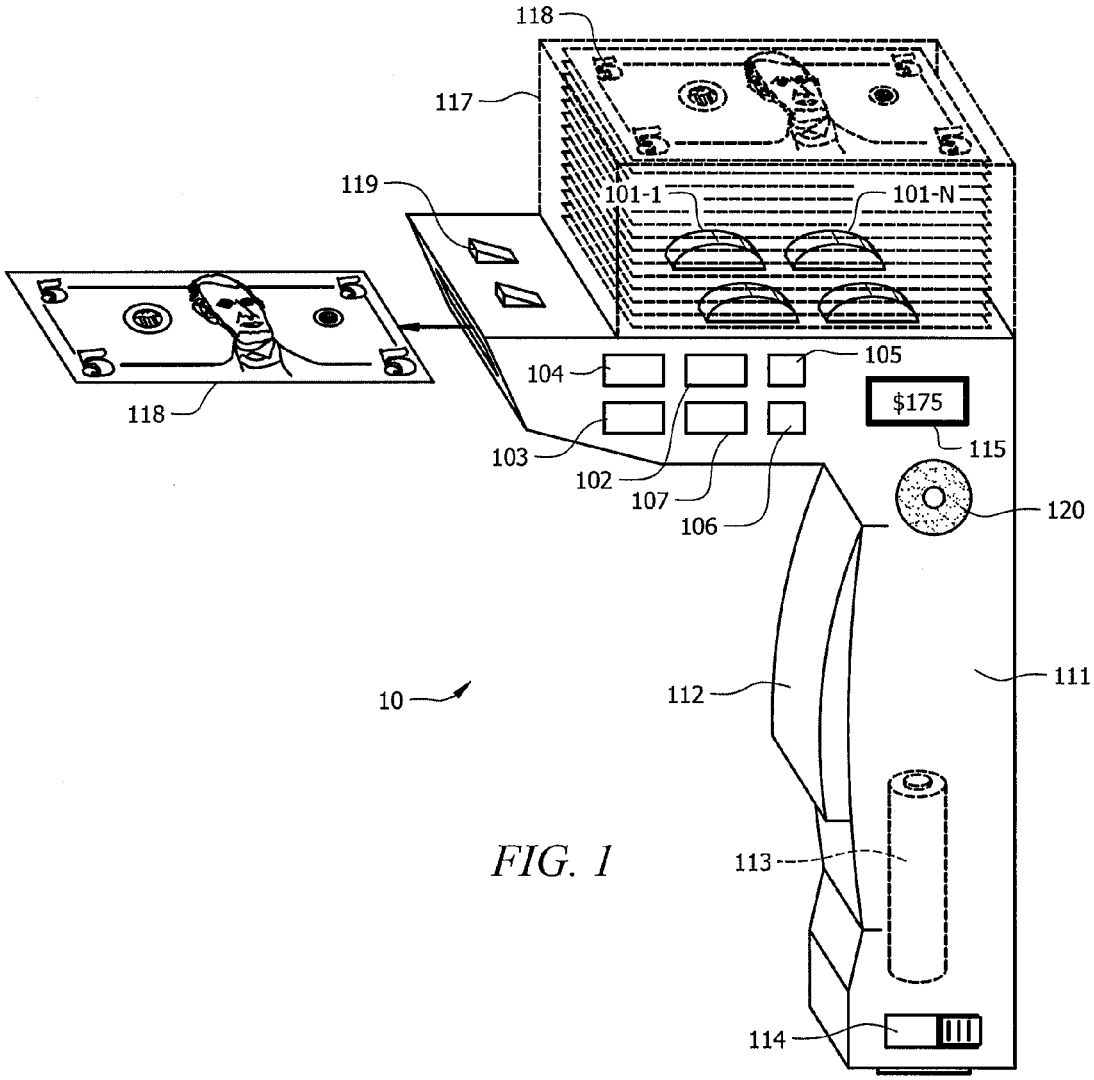
FIG. 1 is one embodiment of the invention showing a battery-operated gun-style money dispenser.

FIG. 1 is one embodiment 10 of the invention showing a battery-operated gun-style money dispenser. Housing 117 holds currency (or currency equivalents) 118. Housing 117 may be fixed in place or removable, or it may be interchangeable with different shapes and sizes of housings. Motorized rollers 101-1 to 101-N propel the currency from the dispenser a distance of at least two feet. Note that any mechanism can be used to effect dispensing the currency, including, air, helium or any other compressed gas. Also note that in some embodiments, "house currency" can be obtained by the patron for use in the dispenser. This house money can be the same size as U.S. paper money, or could be a different size. In some situations, both government issued currency and house currency can be interchanged while in other situations one or the other must be used. Also note that inserts or other mechanisms can be used inside housing 117 to allow for different sized currencies.

Counter 115 tracks how many bills remain in (or have been dispensed from) housing 117. For ease of use, handle 111 is shaped like a pistol grip and can contain power, such as battery 113, for operating the dispatching mechanism. Handle 111 can also have power switch 114 and trigger 112 to control activation of the dispatching mechanism, such as rollers 101-1 to 101-N. When the patron enables power switch 114 and depresses trigger 112, the dispenser shoots currency continuously until trigger 112 is released or until no more currency remains in housing 117 or until, optionally, a pre-set limit is reached.

The pre-set limit can be a dollar amount or a count of currency items dispatched, or any other measure. For example, the dispenser may be equipped with number control 102 which, once set, will allow the gun to shoot the set number of times then prevent further shooting until the number control is reset.

The dispenser may have burst control 107 to set how many times the dispenser fires before the trigger 112 must be released and depressed again to continue firing. When number control 102 and burst control 107 are used in conjunction, number control 102 would set a total limit on shots to be fired, such as thirty, while the burst control 107 would control how many times the dispenser fires each time the trigger is squeezed, for example three. Thus each squeeze of the trigger would shoot three units of currency for ten trigger pulls. On the eleventh pull no more currency is dispatched because the limit of thirty has been reached.

The dispenser may additionally have rate control 103 and distance control 104 to control, respectively, the rate and distance at which the money is dispensed. Another feature would include sound control 105 (giving sound effects, playing music, etc., through speaker 120) and light control 106 (giving light effects through lights 119) for additional entertainment options. In some embodiments, different light colors or different sounds can be associated with different currency amounts. For example, when twenties are being dispatched the sound, and/or light, could be one color (or sound) and when ones are being used a different color or sound would be used.

Figure 2:
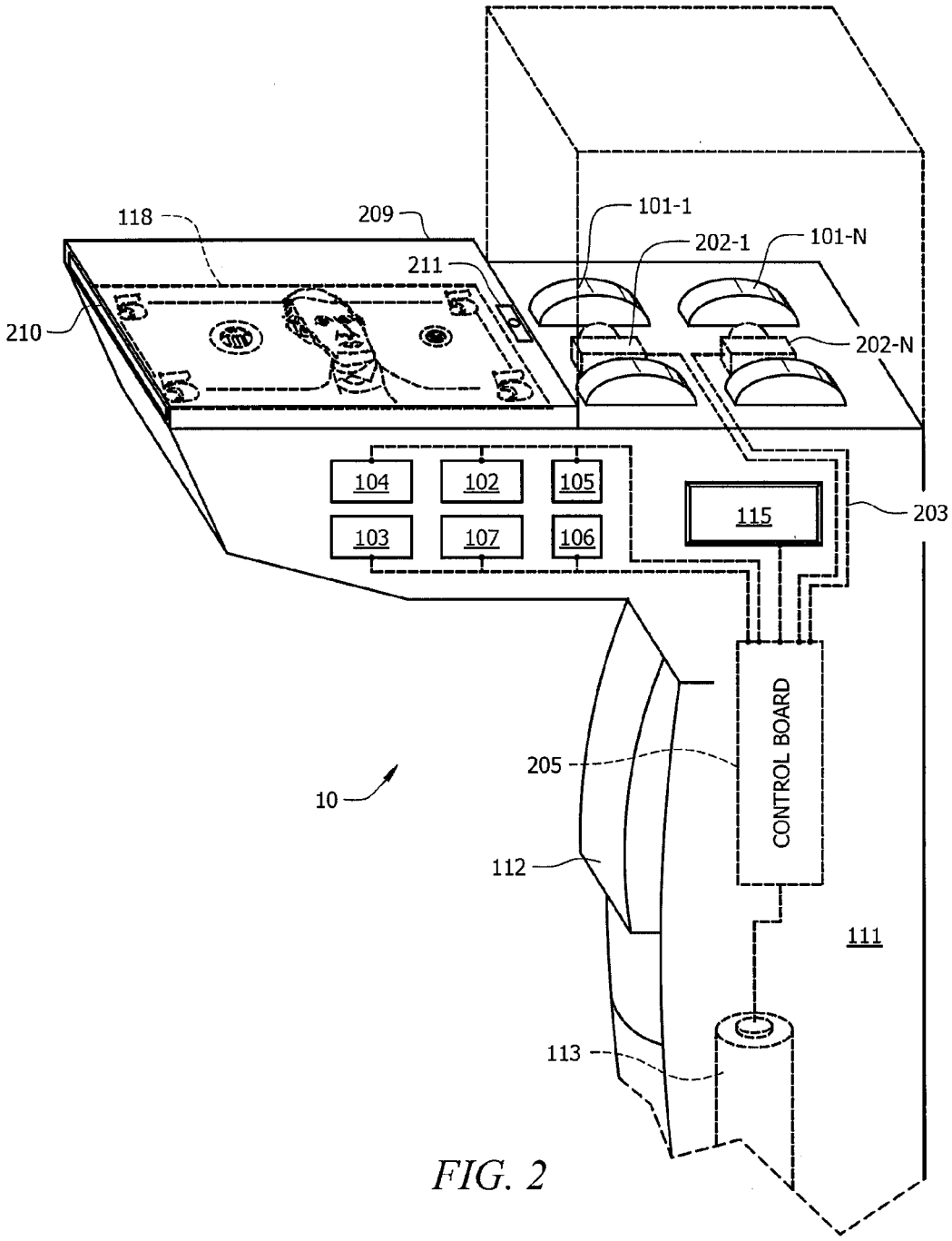
FIG. 2 is an expanded view of the embodiment shown in FIG. 1.

FIG. 2 is an expanded view of embodiment 10 shown in FIG. 1. Recessed rollers 101-1 to 101-N are driven by electric motors 202-1 to 202-N. Motors 202-1 to 202-N are controlled by main control board 205 via control wires 203-1 to 203-N. Main control board 205 is powered by battery 113 and receives inputs from trigger 112 as well as the setting of buttons 102-107. The main control board controls motors 202-1 to 202-N according to the flow chart shown in FIG. 3. When motors 202-1 to 202-N are activated, currency 118 is propelled down channel 209 and through output slot 210.

While it is anticipated that the currency will be dispatched flat, it might happened that in some embodiments the currency might be folded, crumpled, rolled, or otherwise reshaped. Such embodiments would have additional benefits from being propelled further or in shapes designed to add entertainment value.

It should be understood that it is not necessary that there be only a single set of rollers 101-1 to 101-N and a single money channel 209. Embodiments of the invention may use multiple money channels and/or multiple sets of rollers (or other dispensing mechanisms). For example, two or more channels could be employed on the same gun, either stacked vertically or laid horizontally to improve the rain-making effect. Multiple channels could also be set at thirty degrees or some other angle apart for the same purpose.

Sensor 211 allows for automatic reading of the value of currency as it is propelled. This can show individual values, such as the value of the currency currently being dispensed or such as the total amount dispensed since the last reset. In some embodiments, the using patron would set the amount and in other situations an automatic sensor would read the amount and set the display accordingly. This would additionally allow for more exact tracking of the values of currency being dispensed. One or more sensors 211 could be mounted in money clip 118 to sense the amount of money as it is loaded. Money could then be counted in some embodiments incrementally in terms of how much money has been dispensed. In other embodiments it could be sensed decrementally in terms of how much money remains to be dispensed. Still other embodiments may give the option of both incremental and decremental counting.

Figure 3:
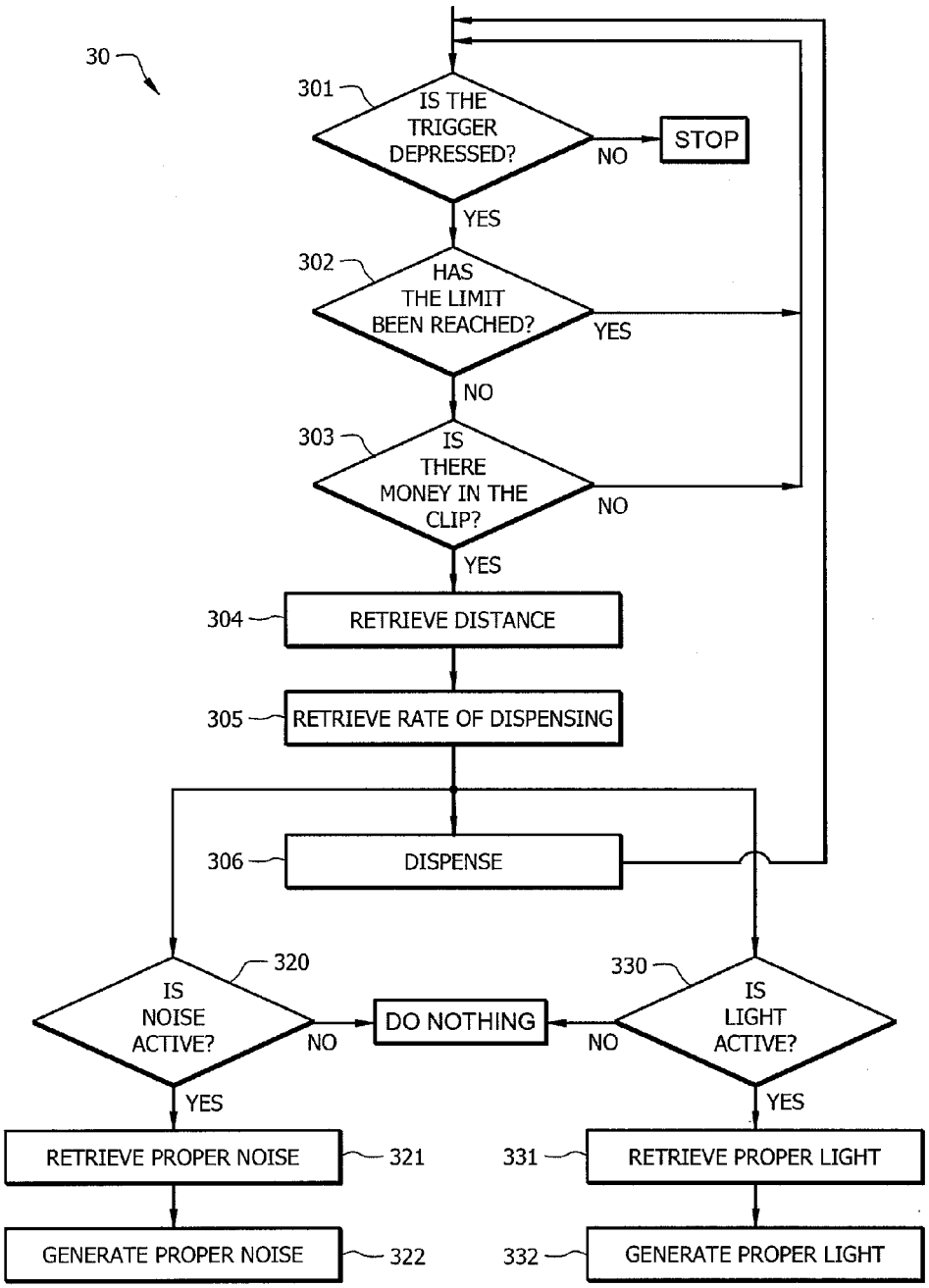
FIG. 3 is a flow chart showing operation of one embodiment of the invention.

FIG. 3 is a flow chart showing operation of one embodiment 30 of the invention. FIG. 3 depicts decision tree and flow chart logic performed, in some embodiments by a processor (not shown) in main control board 205. Process 301 detects when the trigger is being depressed. Process 302 then checks to see if the device has already shot a previously set limit and process 303 determines if money is present in the housing. If the limit has not been reached and money is present, then process 304 (optionally) retrieves the desired distance from a distance setting and process 305 determines the dispensing rate and sets the motor speed accordingly. Process 306 then begins dispensing money. Release of the trigger, reaching the limit, or lack of money in the housing will stop operation of the motors.

Optionally, at the same time money is being dispensed, embodiments of the device may be set to produce a noise show. Once the rate of dispensing is retrieved, process 320 checks to see if noise has been activated. If noise has been activated, process 321 retrieves the proper noise. This noise could be one set by the user, or it could depend from the denomination of the currency, or it could be based on the length of time the trigger is depressed, or it could depend on other user settings (such as the distance set). Once the proper noise has been retrieved, process 322 generates the proper sound.

Optionally, at the same time money is being dispensed, embodiments of the device may be set to produce a light effect show. Once the rate of dispensing is retrieved process 330 checks to see if light effects have been activated. If light effects have been activated, process 331 retrieves the proper light effect. This light effect could be one set by the user, or it could depend from the denomination of the currency, or it could be based on the length of time the trigger is depressed, or it could depend on other user settings (such as the distance set). Once the proper light effect has been retrieved, process 332 generates the proper light. This light could be color, flashing, pulsing or a combination thereof.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A hand-held paper currency dispenser, comprising:

a paper currency receptacle to hold flat paper currency;

a paper currency dispensing mechanism including one or more motorized rollers, wherein said one or more motorized rollers, when activated while flat paper currency is held in said paper currency receptacle, propel at least one item of said flat paper currency out of said hand-held paper currency dispenser;

a controller configured to selectively activate said one or more motorized rollers responsive to an input; and a trigger for activation by a user holding said dispenser, wherein said trigger, when activated, provides said input to said controller to cause said controller to selectively activate said one or more motorized rollers to propel said at least one item of said flat paper currency from said dispenser a distance of at least two feet.

2. The hand-held paper currency dispenser of claim 1 further comprising:

a handle mounted perpendicular to said paper currency receptacle, said handle containing said trigger.

3. The hand-held paper currency dispenser of claim 2 further comprising:

a quantity indicator for informing said user as to an amount of said flat paper currency held in said paper currency receptacle.

4. The hand-held paper currency dispenser of claim 2 wherein said paper currency receptacle is removably attachable to said hand-held paper currency dispenser.

5. The hand-held paper currency dispenser of claim 4 further comprising:

means for allowing a user to set a desired limit on an amount of said flat paper currency propelled from said hand-held paper currency dispenser for each trigger activation.

6. The hand-held paper currency dispenser of claim 1 wherein said paper currency receptacle is interchangeable to hold paper currency of different unit sizes.

7. The hand-held paper currency dispenser of claim 1 further comprising:

means for allowing said user to set a desired limit on an amount of said flat paper currency propelled from said hand-held paper currency dispenser for each trigger activation.

8. The hand-held paper currency dispenser of claim 7 wherein said amount of said flat paper currency is a set number of individual currency units.

9. A paper currency-dispensing apparatus, comprising:

a container for holding flat paper currency;

a plurality of motorized rollers, wherein said plurality of motorized rollers, when activated while flat paper currency is held in said container, propel at least one item of said flat paper currency out of said paper currency-dispensing apparatus;

a propulsion controller for selectively activating said plurality of motorized rollers to propel said at least one item of said flat paper currency out of said paper currency-dispensing apparatus at a user selected rate of speed in response to an input;

an activator control for providing said input to said propulsion controller;

a first user control for allowing said user to set a limit on an amount of said flat paper currency to be dispensed in response to each activation of said activator control; and a second user control for allowing said user to set a limit on a total amount of said flat paper currency to be dispensed independent of a number of times said activator control is activated.

10. The paper currency-dispensing apparatus of claim 9 wherein said container for holding said flat paper currency is removable.

11. The paper currency-dispensing apparatus of claim 9 further comprising:

a burst control for setting a quantity of said flat paper currency to be delivered each time said activator control is depressed.

12. A paper currency dispenser, comprising:

means for holding flat paper currency;

one or more motorized rollers, wherein said one or more motorized rollers propel at least one item of said flat paper currency from said paper currency dispenser a distance of at least two feet when activated while said flat paper currency is held in said means for holding;

means for selectively activating said one or more motorized rollers to propel said at least one item of said flat paper currency out of said paper currency dispenser in response to an input; and means for providing said input to said means for selectively activating said one or more motorized rollers, wherein said means for providing is configured to provide said input responsive to user interaction.

13. The paper currency dispenser of claim 12 further comprising:

means for setting a configurable number for limiting an amount of said flat paper currency to be dispensed.

14. The paper currency dispenser of claim 12 further comprising:

means for setting a configurable distance said flat paper currency should be propelled.

15. The paper currency dispenser of claim 12 further comprising:

means for setting a light show to be enabled when said flat paper currency is propelled.

16. The paper currency dispenser of claim 12 further comprising:

means for setting a sound show to be enabled when said flat paper currency is propelled.

* * * * *